United States Patent [19]

Brandell

[11] 4,078,806

[45] Mar. 14, 1978

[54] GOLF PUTTING PRACTICE DEVICES

[75] Inventor: John R. Brandell, Glenview, Ill.

[73] Assignee: Brandell Products Corporation, Rosemont, Ill.

[21] Appl. No.: 725,955

[22] Filed: Sep. 23, 1976

[51] Int. Cl.[2] ..... A63B 69/36

[52] U.S. Cl. ..... 273/179 A

[58] Field of Search ..... 273/179 A, 127 C, 120 A, 273/121 A, 119 A, 179 R, 179 B

[56] References Cited

U.S. PATENT DOCUMENTS 3,030,113 4/1962 Brandell ..... 273/179 A

OTHER PUBLICATIONS

"Design of Machine Elements", M. F. Spotts, New York, Prentice Hall, Inc., Library of Congress Card Catalog No. 53-9200, pp. 181 and 182.

*Primary Examiner*—George J. Marlo

*Attorney, Agent, or Firm*—Emrich, Root, O'Keeffe & Lee

[57] ABSTRACT

A golf putting practice device embodying a kicker for returning a ball to a person making a putt into the device, and having an abutment member slidably mounted on a wall of the device for abuttingly engaging the kicker and thus determining the force with which a ball is returned by the device, the abutment member being secured to the wall against removal therefrom, with separate means being used to hold the abutment member in adjusted position on the wall.

8 Claims, 4 Drawing Figures

GOLF PUTTING PRACTICE DEVICES

BACKGROUND OF THE INVENTION

This invention relates to golf putting practice devices, and, more particularly, to golf putting practice devices of the type embodying mechanism for kicking a ball back to a person making a putt thereinto.

It is a primary object of the present invention to afford a novel golf putting practice device.

Another object of the present invention is to afford a novel golf putting practice device which embodies a novel control mechanism, constituted and arranged in a novel and expeditious manner in the device, for controlling the force with which a ball is returned toward a person making a putt into the device, and, therefore, the distance which said ball is returned.

Golf putting practice devices embodying kickers mounted therein, and wherein controls are afforded for controlling the force with which a ball is returned from the device, have been heretofore known in the art, such as, for example, as shown in my U.S. Pat. Nos. 2,709,594, 3,003,769, 3,134,597, 3,134,934, 3,265,940, 3,306,619 and 3,810,632. It is an important object of the present invention to afford novel improvements over the golf putting practice devices heretofore known in the art.

Another object of the present invention is to afford a novel golf putting practice device which is practical and efficient in construction and operation, and which may be readily and economically produced commercially.

Other and further objects of the present invention will be apparent from the following description and claims and are illustrated in the accompanying drawings, which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figures 1, 2, 3, 4:
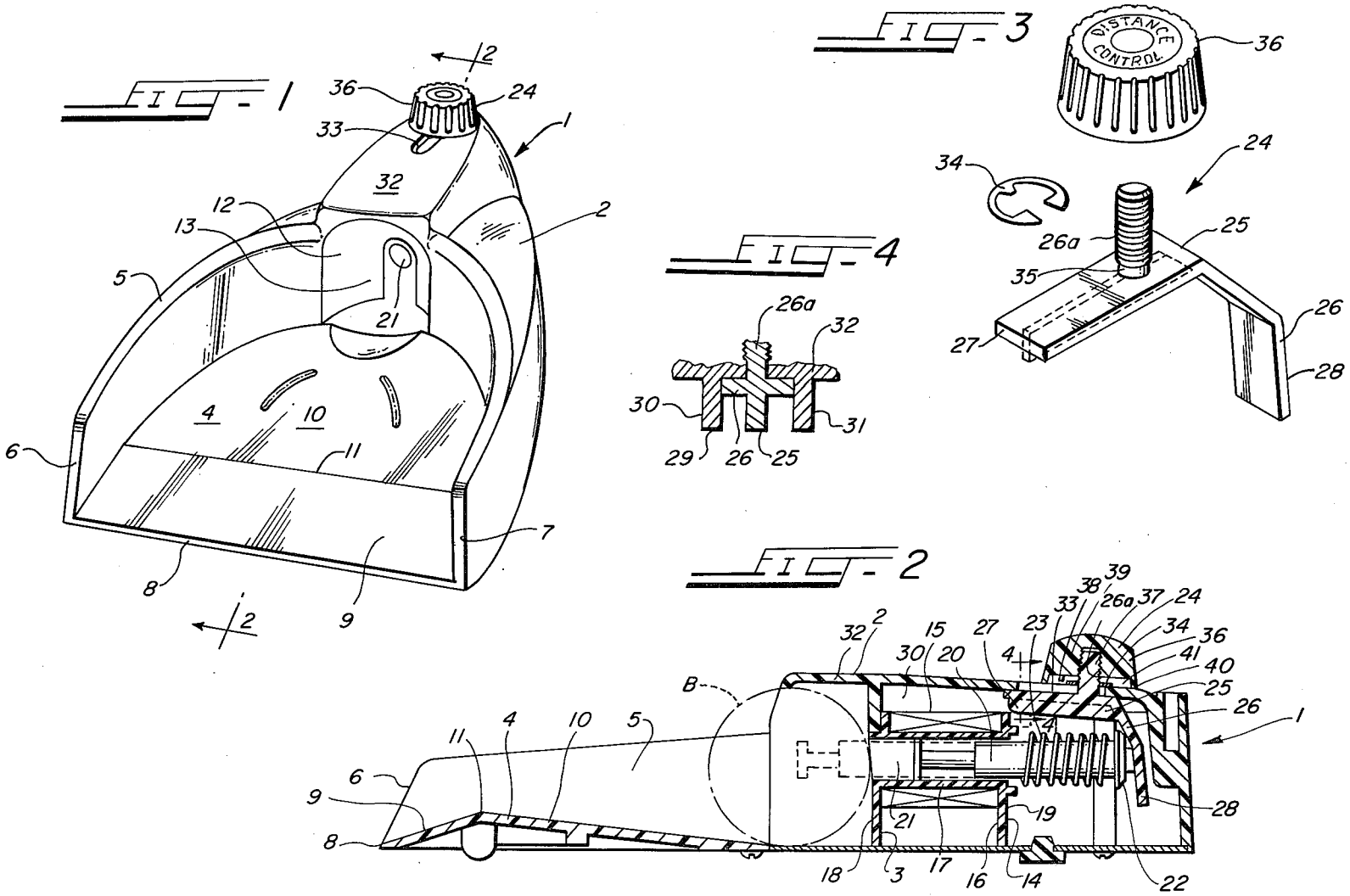
FIG. 1 is a front perspective view of a golf putting practice device embodying the principles of the present invention.
FIG. 2 is a longitudinal sectional view taken substantially along the line 2—2 in FIG. 1.
FIG. 3 is an exploded, perspective view of the ball return control mechanism embodied in the golf putting practice device shown in FIGS. 1 and 2.
FIG. 4 is a sectional view taken on the line 4—4 in FIG. 2.

A game device in the form of a golf putting practice device 1, embodying the principles of the present invention, is shown in FIGS. 1–3, inclusive, of the drawings, to illustrate the presently preferred embodiment of the present invention.

The golf putting practice device 1 is of the same general type as those shown in my aforementioned U.S. Pat. Nos. 2,709,594, 3,003,769, 3,134,597, 3,134,934, 3,265,940, 3,306,619 and 3,810,632, and embodies in general, a base or housing 2, into which a golf ball, such as the ball B shown in broken lines in FIG. 2, may be putted, with a kicker unit 3 disposed in operative position in the base 2 for returning the ball therefrom to the person putting the same.

As in the golf putting practice devices shown in my aforementioned patents, the base 2 includes a floor 4, surrounded at its rear and lateral sides by an upstanding wall 5, the wall 5 terminating at its front ends 6 and 7 in uniplanar relation to the front edge 8 of the floor 4, FIG. 1.

The floor 4 embodies a front ramp 9, which slopes upwardly and rearwardly from the front edge 8 of the floor 4, and a rear ramp 10 which slopes downwardly and rearwardly from the rear edge 11 of the front ramp 9. A ball receiving pocket or station 12, which includes a concave-forwardly recess 13 in the wall 5 is disposed in the base 2 at the rear edge portion of the floor 4.

In the use of the device 1, a ball may be putted from in front thereof upwardly across the front ramp 9 from which it will roll by gravity downwardly across the rear pump 10 of the floor 4 into the ball receiving station 12, from which position it may be ejected forwardly from the device 1 by the kicker 3.

The kicker unit 3 embodies a solenoid 14, which includes a wire coil or winding 15 mounted on a supporting form 16, FIG. 2. The supporting form 16 preferably is made of molded nylon or molded polystyrene, or other suitable moldable material, and embodies a central sleeve 17 extending between two end walls 18 and 19.

The kicker unit 3 also embodies an armature comprising an elongated rod 20, made of suitable magnetic material, such as, for example, steel, and slidably mounted in the sleeve 17 with a relatively snug, but freely slidable fit. The sleeve 17 affords a channel 21 through which the armature 20 may reciprocate longitudinally between a retracted position, such as shown in solid lines in FIG. 2, and a fully forwardly extended position, such as shown in broken lines in FIG. 2. The armature 20 has an outwardly projecting flange or collar 22 on the rear end portion thereof, and a resilient member, in the form of a compression coil spring 23 is disposed on the armature 20 between the rear wall 19 of the supporting form 16, and the collar 22 for yieldingly urging the armature 20 toward retracted position. Energization of the solenoid winding 15 is effective to move the rod 20 forwardly, and the spring 23 is effective to return the rod 20 to retracted position upon de-energization of the winding 15, in the same manner as in the kicker units shown in my aforementioned patents.

A novel control mechanism 24, FIGS. 1–3, is mounted in the base 2 for controlling the force, with which a ball, such as the ball B, is returned toward a person who has putted the ball into the putting device 1. The control mechanism 24 shown herein is somewhat similar to control mechanisms shown in my aforementioned patents, but as will be discussed in greater detail hereinafter is different in specific construction and represents a novel improvement thereover.

The control mechanism 24 embodies a one-piece stop member 25, which includes an abutment member 26 and a supporting member in the form of an externally threaded screw 26*a*, FIGS. 2 and 3. The stop member 25, preferably, is made of a suitable non-magnetic material such as brass.

The abutment member 26 shown herein is similar to the abutment member shown in my aforementioned patents, comprising an elongated slide member having a front upper end portion 27 and a downwardly projecting rear end portion 28, the front upper end portion 27 of the abutment member 26 being slidably mounted in a guideway 29 afforded by two elongated ribs 30 and 31, projecting downwardly from the top wall 32 of the base 2, rearwardly of the wall 5, FIGS. 2 and 4. The ribs 30 and 31 are disposed in substantially parallel relation to each other, and extend rearwardly from the wall 5 along the longitudinal center line of the top wall 32 of the base 3.

An elongated slot 33 is formed in the top wall 32 of the base 2, between, and in parallel relation to the ribs 30 and 31. In the assembled device 1, the screw 26*a* extends through the slot 33 and is held against removal therefrom by a suitable fastening member, such as a snap-ring 34 mounted in an annular groove 35 in the screw 26*a*. With this construction, the stop member 25 is secured to the wall 32 for sliding movement to any position of adjustment along the slot 33. When the stop member 25 is thus mounted on the wall 32, the rear end portion 28 of the abutment member 26 is disposed rearwardly of the rod 20, in axial alignment therewith, in position to engage the rear end of the rod 20, when the latter is retracted by the spring 23, in all positions of the stop member 25 along the slot 33, and is thereby effective to determine the retracted position of the rod 20 in accordance with the positioning of the stop member 25 along the slot 33.

A control knob 36 having a threaded opening 37 in one face 38 of the central body portion 39 thereof is mounted on the outwardly projecting end of the screw 26*a* and is threadedly engaged therewith for movement therealong toward and away from the wall 32. An annular flange 40 extends around the outer periphery of the face 38 and projects outwardly from the body portion 39 beyond the face 38 to define, with the face 38 a cavity 41, which is of sufficient size to receive the snap ring 34 therein with a loose fit, FIG. 2.

With this construction, when it is desired to adjust the position of the stop member 25 along the slot 33, the control knob 36 may be rotated on the screw 26*a* in a direction to advance the knob 36 outwardly away from the wall 32 and thus free the stop member 25 for movement, manually, along the slot 33 into the desired adjusted position relative thereto—the stop member 25 being moved toward the wall 5 to decrease the force with which the rod 20 strikes a ball, such as the ball B, and being moved away from the wall 5 to increase this force. After the stop member 25 has been moved into the desired adjusted position, the control knob 36 may then be rotated in the other direction, to advance it inwardly along the screw 26*a* into position wherein the flange 40 is disposed in abutting engagement with the outer face of the wall portion 32 with a force sufficient to clamp the wall 32 between the flange 40 and the adjacent face of the stop member 25, to thus hold the control mechanism 24 in the desired adjusted position.

With this construction, it will be seen that even if the person using the golf putting practice device 1 should turn the control knob 36 a sufficient distance in the direction effective to loosen it on the screw 26*a* that the knob 36 is completely detached therefrom, the stop member 25 remains supported from the wall 32 by the snap ring 34, so that there is no danger that the stop member 25 will fall downwardly into the base 2.

Also, it will be seen that with the control unit 24, constituted and arranged in the manner disclosed herein, it may be quickly and easily assembled in the base 2. Thus, it is merely necessary for the person assembling the golf putting device 1 to push the screw 26*a* upwardly through the slot 33 into position wherein the stop member 25 is disposed between the flanges 30 and 31, and, while holding the stop member 25 in this position by the fingers of one hand, inserting the snap ring 34 into operative position in the groove 35 with the other hand. Thereafter, the stop member 25 may be released without danger of it becoming dislodged from proper operative position in the base 2. The control knob 36 may then subsequently be screwed onto the screw 26*a* at any convenient time during the assembly of the golf putting practice device 1.

From the foregoing it will be seen that the present invention affords a novel golf putting practice device which embodies a novel control unit for the kicker unit of the device, with the control unit constituted and arranged in the device in a novel and expeditious manner.

In addition, it will be seen that the present invention enables a control unit to be inserted into a golf putting practice device in a novel and expedious manner.

Also, it will be seen that the present invention protects against accidental dislodgment of the control unit from such a golf putting practice device.

Further, it will be seen that the present invention affords a novel golf putting practice device which may be readily and economically produced commercially.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I claim:

1. A game device comprising a. a housing having a ball-receiving station and a floor inclined at a ball-impelling angle sufficient to roll a ball thereon by gravity action toward said station, b. kicker means reciprocable between a retracted position and a forwardly actuated position for ejecting a ball from said station, c. kicker actuating means for reciprocating said kicker means between said positions, and d. means for limiting retracting movement of said kicker means from said forwardly actuated position, e. said means for limiting movement comprising (1) a wall portion of said housing having an elongated opening extending therethrough in substantially parallel relation to the path of travel of said kicker means between said positions, (2) an abutment member having (a) an integral threaded portion extending through said opening and (b) another portion disposed in said path of travel in position to abuttingly engage said kicker means upon movement of the latter from said actuated position to said retracted position, (3) means on said threaded portion and engaging said wall portion on the side thereof remote from said other portion for connecting said abutment member to said wall portion for movement along said opening, and (4) another abutment member threadedly engaged with said threaded portion on the side of said last mentioned means remote from said wall portion and movable along said threaded portion into and out of position to clampingly engage said wall portion between said abutment members in position to releasably hold said first mentioned abutment member in stationary position in said opening.

2. A game device as defined in claim 1, and in which
a. said means on said threaded portion comprises a snap ring removably mounted on said threaded portion.

3. A game device as defined in claim 2, and in which
a. said other abutment member comprises a hollow control knob having
(1) a central portion threadedly engaged with said threaded portion, and
(2) an annular portion
(a) disposed around said snap ring, and
(b) movable into and out of engagement with said wall portion.

4. A golf putting practice device comprising
a. a base including
(1) an upstanding wall having a front face defining a ball-receiving station in said base, and
(2) another wall projecting rearwardly from said upstanding wall,
b. an elongated kicker member
(1) mounted in said base, and
(2) longitudinally reciprocable through said upstanding wall between a forwardly projecting position relative thereto and a retracted position for forwardly ejecting a golf ball from said station,
c. means for longitudinally reciprocating said kicker member between said positions,
d. said other wall having an elongated opening extending therethrough and disposed in substantially parallel relation to said kicker member, and
e. means for adjustably limiting the distance said retracted position is disposed rearwardly of said forwardly projecting position,
f. said last mentioned means comprising
(1) a stop member including
(a) an abutment portion disposed in said housing, and
(b) a screw projecting outwardly through said opening from said abutment member,
(2) said abutment portion projecting from said screw in position to abuttingly engage the rear end of said kicker member when said kicker member is disposed in said retracted position,
(3) means for securing said stop member to said other wall for reciprocation along said opening to thereby adjust said retracted position, and
(4) separate means for releasably clamping said other wall between said separate means and said abutment member for releasably holding said stop member in adjusted position along said opening.

5. A golf putting practice device as defined in claim 4, and in which
a. said means for securing comprises a member mounted on said screw outwardly of said other wall.

6. A golf putting practice device as defined in claim 5, and in which
a. said separate means comprises a control knob disposed outwardly of said other wall and including
(1) a central portion threadedly engaged with said screw for movement therealong toward and away from said other wall, and
(2) an annular flange extending around and projecting from said central portion in position to
(a) encircle said securing means, and
(b) abuttingly engage said other wall outwardly of said securing means upon movement of said central portion along said screw toward said other wall.

7. A golf putting practice device as defined in claim 6, and in which
a. said screw has an annular external groove extending therearound, and
b. said securing means comprises a snap ring removably mounted in said groove.

8. In a golf putting practice device including a base embodying a ball-receiving station, kicker means for ejecting a ball from said station, said kicker means including a kicker member reciprocable between a forwardly extended position and a rearwardly retracted position for so ejecting such a ball upon movement of said kicker member from said retracted position to said extended position, and said base including an outer wall portion having an elongated opening therethrough disposed in substantially parallel relation to the path of travel of said kicker member between said extended and retracted positions, the combination of:
a. a one-piece stop member comprising
(1) an abutment member abuttingly engaged with the inner face of said wall portion, and
(2) an externally threaded screw projecting from said abutment member and extending outwardly through said opening,
b. means mounted on said screw outwardly of said wall portion for securing said stop member to said wall portion for sliding movement along said opening,
c. said abutment member projecting inwardly from said wall portion into position to abuttingly engage said kicker member and thus determine said retracted position thereof in all positions of said stop member along said opening, and
d. a control knob comprising
(1) a central portion having a threaded opening in one face thereof, and
(2) an annular flange projecting from said last mentioned face in outwardly spaced, surrounding relation to said threaded opening,
e. said screw being threadedly engaged in said threaded opening, and
f. said knob being movable along said screw, upon rotation of said knob relative thereto, into and out of position to abuttingly engage said flange with the outer face of said wall portion outwardly of said means on said screw for thereby releasably holding said stop member in selected adjusted position relative to said elongated opening.

* * * * *